US006755584B2

(12) United States Patent
O'Brien et al.

(10) Patent No.: US 6,755,584 B2
(45) Date of Patent: Jun. 29, 2004

(54) WRITING INSTRUMENT

(75) Inventors: Richard C. O'Brien, Oxford, CT (US); Donald A. DeLuca, Guilford, CT (US); Michael Kent, Cheshire, CT (US)

(73) Assignee: BIC Corporation, Milford, CT (US)

( * ) Notice: Subject to any disclaimer, the term of this patent is extended or adjusted under 35 U.S.C. 154(b) by 0 days.

(21) Appl. No.: 10/053,621

(22) Filed: Jan. 24, 2002

(65) Prior Publication Data

US 2003/0138283 A1 Jul. 24, 2003

(51) Int. Cl.[7] ..... B43K 7/12
(52) U.S. Cl. ..... 401/117; 401/109; 401/99
(58) Field of Search ..... 401/112, 113, 401/114, 117, 104–106, 109, 99

(56) References Cited

U.S. PATENT DOCUMENTS

| | | | | |
|---|---|---|---|---|
| 1,595,150 A | | 8/1926 | Greening | |
| 2,580,753 A | | 1/1952 | Frentzel | 120/42.03 |
| 2,722,914 A | | 11/1955 | Aversa | 120/42.03 |
| 2,789,304 A | | 4/1957 | Leavin | 15/184 |
| 3,037,483 A | | 6/1962 | Caviglione | 120/42.03 |
| 3,181,507 A | | 5/1965 | Dannebaum | 120/42.03 |
| 3,865,496 A | | 2/1975 | Robbins | 401/17 |
| 3,883,253 A | | 5/1975 | Naruse et al. | 401/65 |
| 3,920,337 A | | 11/1975 | Ganz | 401/106 |
| 3,994,605 A | | 11/1976 | McKnight | 401/99 |
| 4,227,823 A | * | 10/1980 | Kitzerow | 401/99 |
| 4,653,949 A | | 3/1987 | Larizza | 401/99 |
| 4,917,519 A | | 4/1990 | White et al. | 401/99 |
| 5,184,908 A | | 2/1993 | Yamamoto et al. | 401/29 |
| 5,186,562 A | | 2/1993 | Yoshinaga et al. | 401/112 |
| 5,564,849 A | * | 10/1996 | Greer, Jr. | 401/30 |
| 5,599,122 A | * | 2/1997 | Yu | 401/31 |
| 5,927,882 A | | 7/1999 | Kageyama | 401/52 |
| 5,971,644 A | | 10/1999 | Kageyama et al. | 401/99 |
| 6,065,889 A | | 5/2000 | Maruyama et al. | 401/65 |
| 6,095,706 A | | 8/2000 | Hashimoto et al. | 401/111 |
| 6,200,050 B1 | | 3/2001 | Lin | 401/104 |
| 6,224,282 B1 | | 5/2001 | Ueki | 401/109 |

FOREIGN PATENT DOCUMENTS

| | | | |
|---|---|---|---|
| DE | 27 04 055 A1 | 8/1978 | |
| DE | 37 05 097 A1 | 9/1987 | B43K/21/06 |
| DE | 39 22 777 C1 | 6/1990 | B43K/24/04 |
| DE | 42 29 976 A1 | 3/1994 | B43K/24/02 |
| DE | 44 00 583 A1 | 7/1995 | B43K/24/02 |
| EP | 0 357 833 A1 | 3/1990 | B43K/21/00 |
| GB | 2 047 629 A | 12/1980 | B43K/21/00 |
| JP | 409123676 A | 5/1997 | B43K/24/08 |
| WO | WO 94/05512 | 3/1994 | B43K/7/12 |

* cited by examiner

*Primary Examiner*—Huyen D Le
(74) *Attorney, Agent, or Firm*—Jones Day

(57) ABSTRACT

A writing instrument includes a barrel having a channel with an open end, and a writing element disposed in the channel. The writing element is movable between a retracted position and an extended position. At least a portion of the writing element is resilient and may be resiliently deflected in a direction substantially transverse to the longitudinal axis of the writing instrument. The resilient deflection of the writing element biases the writing element to engage the channel and to retain the writing element in the extended position. Various other features which improve the functioning of the writing instrument or actuator member may be provided separately or in combination. In example, the actuator may be mounted for non-linear movement to extend or retract a writing element. Also a release member may be provided along a side of the barrel to move the writing element out of engagement with the channel.

36 Claims, 7 Drawing Sheets

WRITING INSTRUMENT

TECHNICAL FIELD OF THE INVENTION

The present invention is directed to writing instruments and, in particular, to writing instruments having a retraction mechanism for selectively retracting or extending a writing element.

BACKGROUND OF THE INVENTION

Writing instruments are commonly equipped with a retractable writing element. According to one example, a writing instrument may include a press button adapted to control the position of the writing element with respect to the writing instrument barrel. When the press button is pressed toward the writing end of the writing instrument, the writing end of the writing element is forced out of the barrel to allow the writing instrument to be used for writing. After the user is finished writing, the press button may be released, or pressed again, to cause the writing end of the writing element to retract back into the barrel.

Due to increasing attention to ergonomic designs, the location, operation, appearance, and structure of writing element retraction mechanisms have varied over the years. For example, International Publication No. WO 94/05512 describes a writing instrument including a barrel for housing a replaceable cartridge, and a retracting plunger mechanism attached to the rear end of the barrel. The retracting plunger is adapted for axial movement between a first position corresponding to the cartridge being retracted within the barrel, and a second position corresponding to the cartridge being protracted from the barrel. A coiled compression spring urges the cartridge and consequently the retracting plunger toward the retracted position. The retracting plunger includes a latch means for engaging a slot in the barrel and locking the retracting plunger in the protracted position. The retaining plunger also includes a projection for maintaining the cartridge in a deflected position that is spaced from the axial centerline of the barrel, such that the compression spring, through the cartridge, imparts a moment on the retracting plunger that transmits a downward force to the latch means. The downward force on the latch means maintains the latch means in the slot in the barrel when in the protracted position. A user may lift up on the latch means to release the latch means from the slot to return the cartridge to the retracted position.

Another example is shown in German Patent Application No. 39 22 777 C1, which discloses a pen having a retractable tip. The pen includes a shaft having a vent hole, and a writing element that may be moved sideways with respect to the longitudinal axis of the shaft. Moving the tip sideways biases the tip onto a sealing surface and maintains the writing element in a retracted position.

Various other retraction mechanism are described in U.S. Pat. No. 6,095,706, United Kingdom Patent Application No. 2 047 629 A, and German Patent No. 37 05 097 A1.

There still remains, however, a need for a writing element retraction mechanism that provides smooth and easy operation, has a reduced number of components, and is aesthetically pleasing and fun to use.

SUMMARY OF THE INVENTION

The present invention is directed to a writing instrument. The writing instrument includes a barrel having a channel with an open end, and a writing element disposed in the channel. The writing element is movable between a retracted position and an extended position. At least a portion of the writing element is resilient and may be resiliently deflected in a direction substantially transverse to the longitudinal axis of the writing instrument. The resilient deflection of the writing element biases the writing element to engage the channel and retain the writing element in the extended position. For example, the writing element may be bent such that the resiliency biases the writing element to engage the channel.

According to one embodiment, the writing instrument may include a first engagement member (e.g., a pawl) associated with the writing element, wherein the first engagement member engages the channel. Additionally or alternatively, the writing instrument may include a second engagement member (e.g., an indentation in the barrel), wherein the first engagement member engages the second engagement member. According to another embodiment, the writing instrument may include a sleeve member disposed in the channel for receiving a portion of the writing element. If the sleeve member is provided, the first engagement member may be located on the sleeve member.

According to another aspect of the present invention, movement of the writing element in a direction substantially transverse to the longitudinal axis of the writing instrument disengages the writing element from the channel, such that the writing element returns to the retracted position. This may be accomplished, for example, by bending the writing element.

The writing instrument may further include a release member located on a side surface of the barrel and movable from a rest position to a release position. Movement of the release member to the release position may cause the writing element to disengage from the channel. For example, the release member may bend the writing element. The release member may contact the first engagement member (if provided), or it may contact the writing element at a location spaced from the first engagement member. According to one embodiment, the release member may be a cantilever beam. According to another embodiment, the release member may be pivotably connected to the barrel. According to yet another embodiment, the release member may be a part of a grip element located on the barrel.

According to another aspect of the present invention, the writing instrument may include an actuator member disposed on a side surface of the barrel and movable between a retracted position and an extended position. The actuator member may move along a non-linear path between the retracted and extended positions. For example, the actuator member may move along an arcuate path between the retracted position and the extended position. Further, the actuator member may slide along a non-planar surface between the retracted position and the extended position. The non-planar surface may be concave or any other non-planar surface known in the art.

BRIEF DESCRIPTION OF THE DRAWINGS

The detailed description will be better understood in conjunction with the accompanying drawings, wherein like reference characters represent like elements, as follows.

DETAILED DESCRIPTION OF THE PREFERRED EMBODIMENTS

Figure 1:
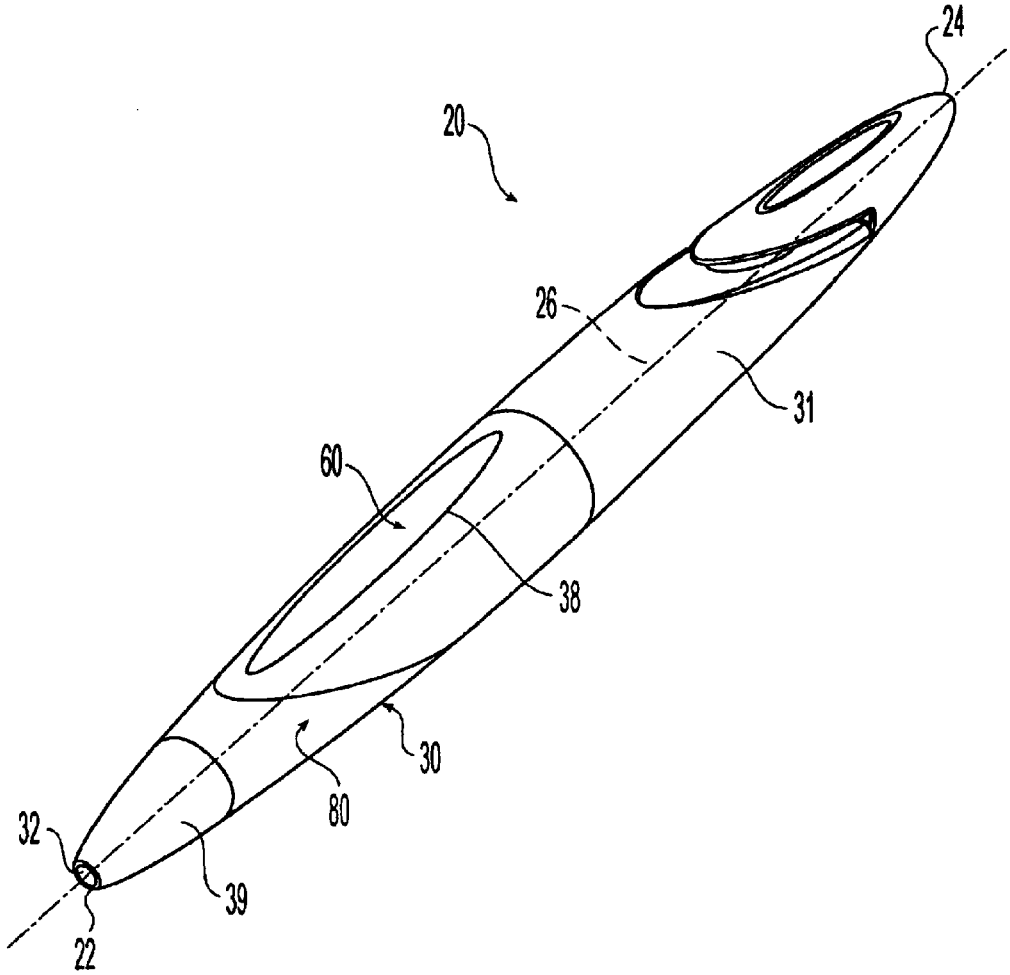
FIG. 1 is a perspective view of a writing instrument according to the present invention.
Figure 2:
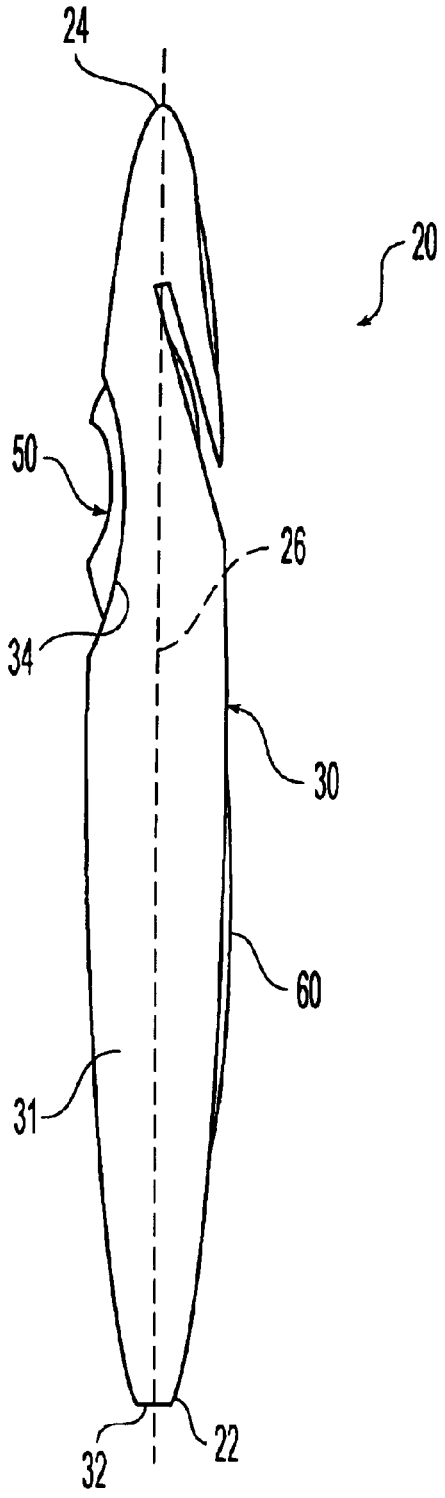
FIG. 2 is a side elevational view of the writing instrument of FIG. 1.
Figure 3:
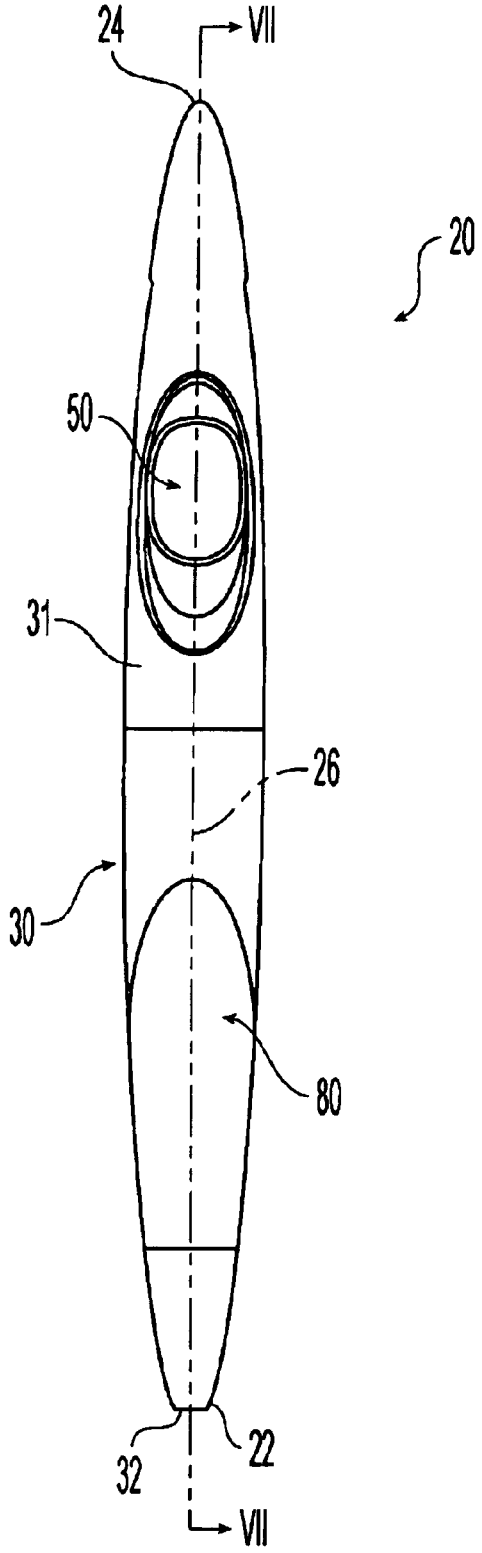
FIG. 3 is a top elevational view of the writing instrument of FIG. 1.

Referring to FIGS. 1–3, an illustrative writing instrument formed in accordance with the principles of the present invention is shown as writing instrument 20. Writing instrument 20 has a first end 22, referred to herein as writing end 22, and a second end 24, referred to herein as non-writing end 24. Writing instrument 20 defines a longitudinal axis 26 between writing end 22 and non-writing end 24. Longitudinal axis 26 is used herein for reference only, and does not imply any shape to writing instrument 20. For example, writing instrument 20 may be curved and still define a longitudinal axis.

Figure 4:
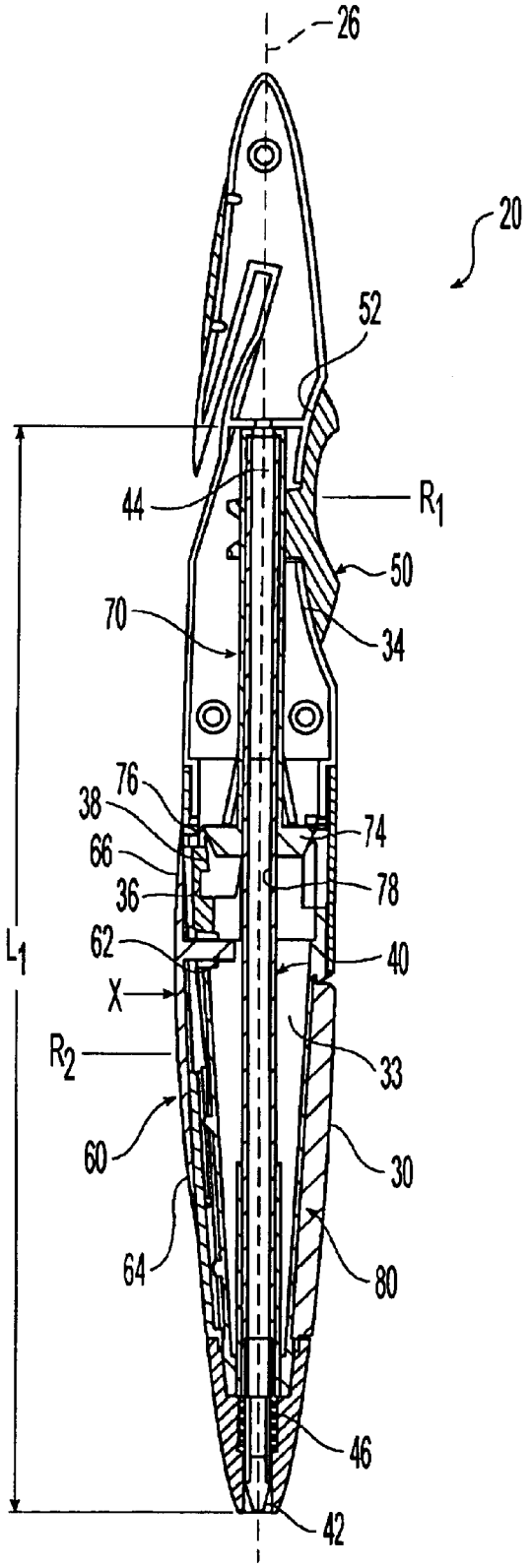
FIG. 4 is a cross-sectional view of the writing instrument of FIG. 1, taken along line IV—IV of FIG. 3.

Writing instrument 20 includes a barrel 30 in the form of an elongated tubular body having a side surface 31 that extends generally parallel to longitudinal axis 26. Side surface 31 may include indentations or other variations intermediate writing end 22 and non-writing end 24 that are not parallel to longitudinal axis 26—only writing end 22 and non-writing end 24 are excluded. Barrel 30 defines an aperture 32 at writing end 22 of writing instrument 20. As shown in FIG. 4, barrel 30 has an inner surface that defines a channel 33, which extends from aperture 32 toward non-writing end 24 of writing instrument 20. A writing element 40, shown in FIG. 4, is disposed in channel 33 and is slidable therein. Writing element 40 includes a writing end 42 for writing or marking, and a non-writing end 44. Preferably, writing element 40 is slidable in channel 33 between a "retracted" position, where writing end 42 is retracted in channel 33, and an "extended" position, where writing end 42 extends out of channel 33 through aperture 32. A biasing element 46, shown in FIG. 4, may be provided to bias writing element 40 toward the non-writing end 24 of writing instrument 20, such that writing element 40 is normally in the retracted position. Biasing element 46 is shown as a spring, but may alternatively be an elastomer or any other resilient member known in the art. While writing element 40 is shown in FIG. 4 as an ink cartridge with a ball point tip, the present invention is not limited to this type of writing element. Any type of ink cartridge may be used, including, without limitation, a filler-type cartridge, a ball-point ink cartridge, a free-ink cartridge, or a gel ink cartridge. In fact, any type of writing or marking element known to one of ordinary skill in the art, such as a fountain pen, felt-tip pen, marker, highlighter, lead pencil, mechanical pencil, stylus (e.g., for a personal digital assistant), etc., may be used as writing element 40 according to the present invention.

Referring back to FIGS. 1–3, writing instrument 20 also includes an actuator member 50, which may be located on side surface 31 of barrel 30. Actuator member 50 is preferably movable along longitudinal axis 26 between a first position and a second position. When in the first position, actuator member 50 defines a first length $L_1$ (illustrated in FIG. 4) between actuator member 50 and aperture 32 along longitudinal axis 26, and when in the second position (not shown), defines a second, smaller length (not illustrated) between actuator member 50 and aperture 32 along longitudinal axis 26. Movement of actuator member 50 from the first position toward the second position causes writing element 50 to move, against the force of biasing member 46, from the retracted position to the extended position.

Writing instrument 20 also includes a release member 60, which may be used to return writing element 40 from the extended position to the retracted position. As shown in FIG. 4, writing instrument 20 may also include an optional sleeve member 70, which receives writing element 40. A grip element 80 may be optionally provided on barrel 30.

Actuator member 50 and/or barrel 30 may be dimensioned and configured such that actuator member 50 moves along a non-linear path as it is moved between the first and second positions. For example, actuator member 50 may be located on a non-planar surface 34 of barrel 30, such that actuator member 50 moves along a non-linear path as it is moved from the first position to the second position. As shown in FIGS. 2 and 4, non-planar surface 34 may be formed as a concave, curvate depression 34 in barrel 30, so that actuator member 50 moves along an arc between the first and second positions. Additionally or alternatively, non-planar surface 34 may be provided on actuator member 50. One of ordinary skill in the art will know and appreciate that non-planar surface 34 is not limited to the configuration shown, and that non-planar surface 34 may alternatively be convex, V-shaped, angular, undulating, free-form, or any other non-planar shape known to one of ordinary skill in the art. One of ordinary skill in the art will also know and appreciate that non-planar surface 34 is not limited to the location shown, and may be located at any position on barrel 30. Actuator member 50 may additionally have an undersurface 52 that is shaped to complement non-planar surface 34 of barrel 30, although non-complimentary configurations are possible as well.

Figure 5:
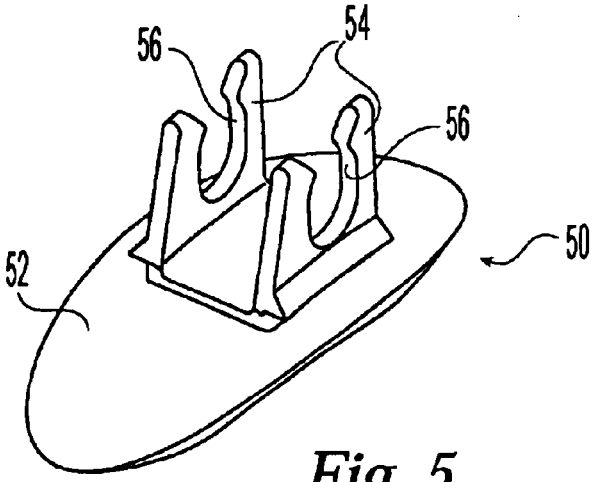
FIG. 5 is a perspective view of an actuator member of the writing instrument of FIG. 1.
Figure 7:
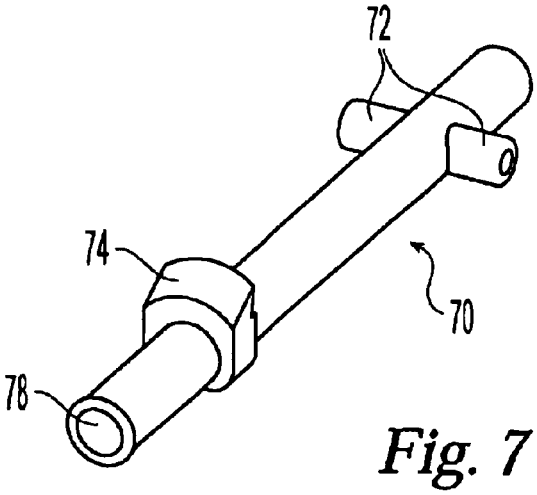
FIG. 7 is a perspective view of a sleeve member of the writing instrument of FIG. 1.

Due to the non-linear path of actuator member 50, actuator member 50 pivots with respect to writing element 40 as it is moved between the first and second positions. This pivoting may cause binding at the junction of writing element 40 and actuator member 50, and/or undesirable bending or flexing of writing element 40. To avoid this, the writing element 40 and/or actuating member 50 may be configured and dimensioned to provide a pivotable connection between the two parts. As shown in FIG. 5, actuator member 50 may be provided with one or more attachment members 54, which may extend through one or more apertures (not shown) in non-planar surface 34, and writing element 40 may be provided with one or more attachment lugs 72 for coupling with attachment members 54. Attachment lugs 72 may be formed directly on writing element 40, or, as shown in FIGS. 4 and 7, attachment lugs 72 may be formed on optional sleeve member 70, which is discussed in detail below. Attachment members 54 may be dimensioned and configured to connect to attachment lugs 72 and to provide for pivoting between the two parts. For example, attachment members 54 may be provided with bores 56 which may receive pin-shaped attachment lugs 72, although any number of linkages known in the art may be utilized to provide a pivotable connection between actuator member 50 and writing element 40.

To retain writing element 40 in the extended position, a portion of writing element 40 may engage a portion of barrel 30. For example, as shown in FIG. 4, writing element 40 may be provided with a first engagement member 74, and channel 33 may be provided with a second engagement member 36 for releasably engaging first engagement member 74. First engagement member 74 may be provided directly on writing element 40, or, as shown in FIGS. 4 and 7, first engagement member 74 may be provided on optional sleeve member 70.

When writing element 40 is in the extended position, first engagement member 74 is preferably biased into engagement with second engagement member 36, under the force of writing element 40. This biased engagement may be accomplished by using writing element 40 as a living spring. More specifically, when writing element 40 is in the retracted position, shown in FIG. 4, writing element 40 is in an "undeflected" or "rest" position (e.g., writing element 40 is substantially unbent along its length), and thus provides no restoration force (i.e., a force tending to return writing element 40 to the rest position). However, as writing element 40 is moved from the retracted position to the extended position, interaction between first engagement member 74 and second engagement member 36 causes writing element 40 to deflect laterally (i.e., in a direction substantially transverse to longitudinal axis 26 of writing instrument 20), thus creating a restoration force in writing element 40. Once writing element 40 is moved substantially completely into the extended position, writing element 40 is still partially deflected and thus provides a restoration force that biases first engagement member 74 and second engagement member 36 into engagement with each other. This restoration force should be sufficient to maintain first engagement member 74 and second engagement member 36 engaged with each other when a user writes with writing instrument 20. A spring or other elastic element may be utilized to provide additional force to bias first engagement member 74 into engagement with second engagement member 36. For example, a spring may be disposed between channel 33 and writing element 40, such that the spring biases first engagement member 74 into engagement with second engagement member 36.

In the illustrative embodiment shown in FIG. 4, and with no intention of limiting the scope of the present invention, first engagement member 74 is shown as a pawl 74, and second engagement member 36 is shown as an indentation 36 that may receive pawl 74, although other configurations are within the present invention. In order to provide a smooth action as writing element 40 is moved from the retracted position to the extended position, a first inclined surface 76 may be provided on pawl 74, and/or a second inclined surface 38 may be provided on or adjacent indentation 33. Thus, as a user moves actuator member 50 toward the second position (and moves writing element toward the extended position), first inclined surface 76 contacts and rides along second inclined surface 38, causing gradual deflection in writing element 40. This gradual deflection of writing element 40 provides a smooth increase in the amount of force required to move actuator member 50, rather than an abrupt increase; and thus provides a smooth feel to the user. Once writing element 40 has substantially completely reached the extended position, the restoration force of writing element 40 causes pawl 74 to engage indentation 36 and to retain writing element 40 in the extended position. One of ordinary skill in the art will know and appreciate that pawl 74 may alternatively be provided on channel 33 with indentation 36 provided on writing instrument. Furthermore, one of ordinary skill in the art will know and appreciate that any type of engagement members may be utilized to maintain writing element 40 in the extended position, and that the present invention is not limited to the structures described above.

Figure 6:
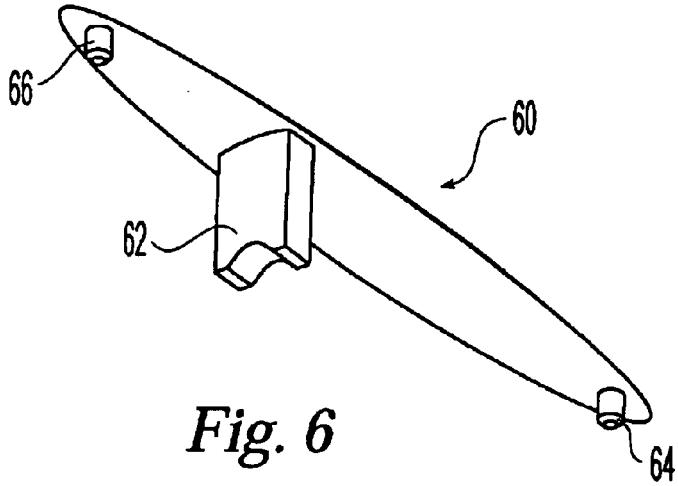
FIG. 6 is a perspective view of a release member of the writing instrument of FIG. 1.

As shown in FIGS. 1–3, release member 60 may be provided on the side surface 31 of barrel 30, although other locations are also contemplated by the present invention. Release member 60 may be used to deflect writing element 40 in a direction substantially transverse to longitudinal axis 26 in order to disengage writing element 40 from the extended position, and thereby to cause writing element 40 to retract from the extended position to the retracted position. In the illustrative embodiment shown in FIG. 4, release member 60 is normally located at a rest position (shown), and may be moved radially inward (in the direction of arrow X in FIG. 4) to a release position (not shown), in which release member 60 disengages first engagement member 74 from second engagement member 36. In the embodiment shown in FIG. 4, release member 60 is located over an aperture 38 (shown in FIG. 1) defined in barrel 30, and is only supported at its ends 64, 66, such that release member 60 may be deflected radially. A portion 62 of release member 60, shown in FIGS. 4 and 6, extends into barrel 30 through aperture 38, and contacts writing element 40. Radially inward deflection of release member 60 causes portion 62 to deflect writing element 40 and first engagement member 74 in a direction substantially transverse to longitudinal axis 26 and, consequently, to disengage first engagement member 74 from second engagement member 36. This disengagement causes writing element 40 to retract to the retracted position under the force of biasing member 46. Writing element 40 and/or release member 60 are preferably elastically biased such that upon return of release member 60 to the rest position, writing element 40 returns to its original position. Release member 60 may be formed of an elastomeric material (e.g., it may be a portion of grip member 80), or it may be a resilient plastic, metal, or other resilient material known in the art.

Figure 8:
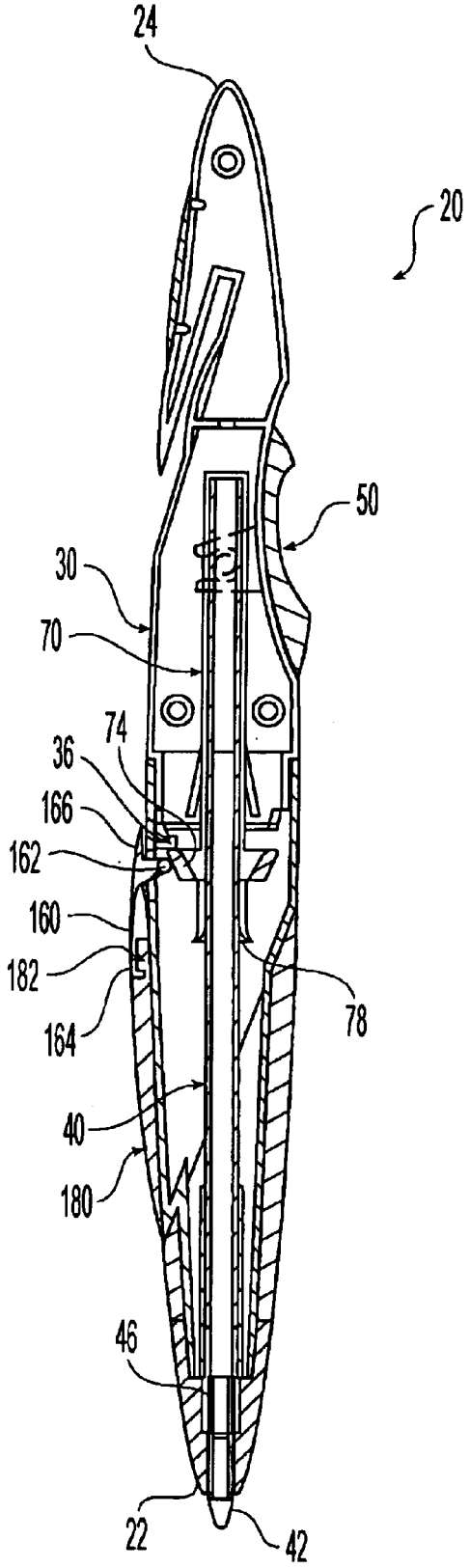
FIG. 8 is a cross-sectional view of a second embodiment of the release member.

A second embodiment of the release member is shown in FIG. 8 as release member 160. According to this embodiment, first end 162 of release member 160 pivots about second end 164, which is pivotally attached to barrel 30 (e.g., by a pair of snaps or other members that couple to barrel 30). A portion 162 of release member 160 near second end 166 extends through barrel 30 and contacts first engagement member 74 directly. When release member 160 is moved from the rest position to the release position, portion 162 pushes directly on first engagement member 74 in order to deflect writing element 40 and to retract writing element 40. By contacting first engagement member 74 directly, frictional forces between release member 160 and writing element 40 are minimized, and thus release member 160 provides a faster, snappier retraction when a user presses on release member 160. Further to this embodiment, a resilient member may be disposed between release member 160 and barrel 30 to bias release member 160 to the rest position. As shown in FIG. 8, this resilient member may be a portion 182 of grip member 180 that is located between second end 164 of release member 160 and barrel 30. In this case, grip element 180 is preferably an elastomeric material that is co-molded with barrel 30. One of ordinary skill in the art will know and appreciate, however, that any number of resilient members may be used to bias release member 160 to the rest position. If provided, grip element 180 and release member 160 may be formed of complementary shapes, such that, e.g., when viewed together on barrel 30, the two parts combine to form the outline of an oval.

Figure 9:
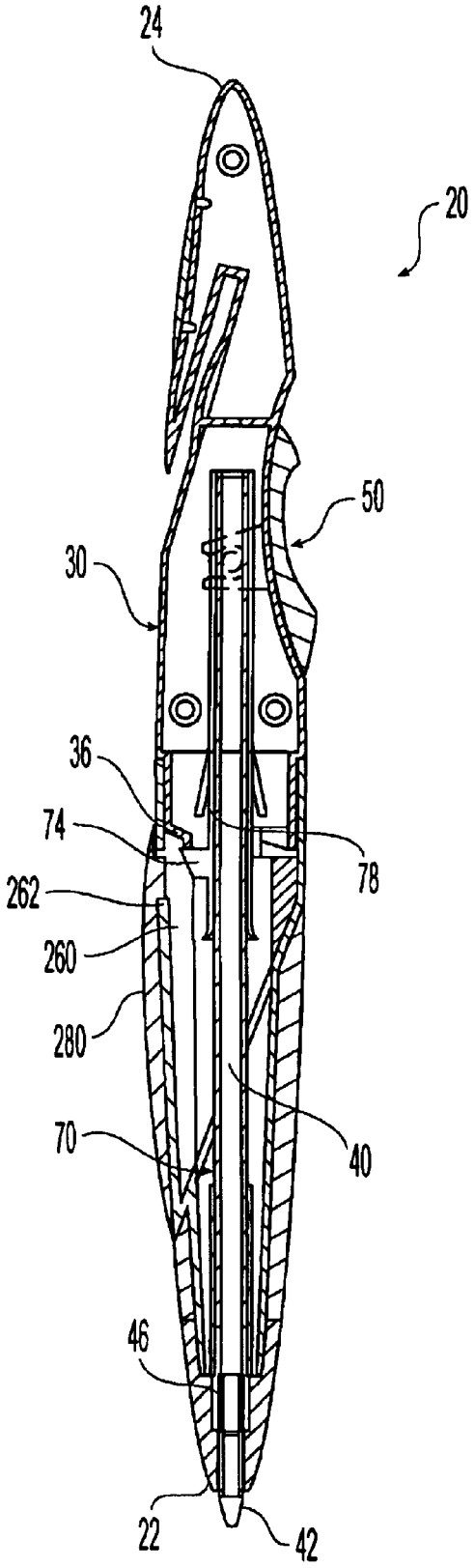
FIG. 9 is a cross-sectional view of a third embodiment of the release member.

A third embodiment of the release member is shown in FIG. 9 as release member 260. According to this embodiment, release member 260 is a cantilever beam. Release member 260 may be an additional cantilever member that is attached to barrel 30 (e.g., by bonding or welding), or release member 260 may be formed integrally with barrel 30 (e.g., by cutting the material of barrel 30 to define an outline of release member 260). A portion 262 of release member is located on barrel 30 such that it may contact first engagement member 74 when a user depresses release member 262 to the release position. However, portion 262 may alternatively contact writing element 40 instead. As shown in FIG. 9, grip element 280 preferably covers release member 260, and also covers any apertures defined in barrel 30 around release member 260, thus preventing dirt, oil, solvents, or any other contaminants from entering barrel 30 near release member 260.

One of ordinary skill in the art will know and appreciate that release member 60, 160, 260 is not limited to the configurations shown, and may have any configuration that imparts movement to writing element 40 in a direction causing retraction of writing element 40. One of ordinary skill in the art will also know and appreciate that release member 60, 160, 260 is not limited to radially inward movement, and may alternatively move radially outwardly or any other lateral direction in order to disengage writing element 40 from barrel 30.

As shown in the figures, actuator member 50 and release member 60, 160, 260 may be located at different radial orientations with respect to each other about longitudinal axis 26. More specifically, as shown in FIG. 1, actuator member 50 may be located at a first radial position $R_1$, and release member 60 may be located at a second radial position $R_2$. In the embodiment shown, first radial position $R_1$ and second radial position $R_2$ are oriented about 180° apart from one another about longitudinal axis 26, however other orientations of actuator member 50 and release member 60 are possible, e.g., by altering the angular orientation of first engagement member 74 and/or second engagement member 36. For example, first radial position $R_1$ and second radial position $R_2$ could be oriented 60°, 85°, or 120° apart from one another. Furthermore, one of ordinary skill in the art will know and appreciate that actuator member 50 and release member 60 are not limited to the locations shown, and may be provided at any locations on barrel 30.

Referring to FIG. 7, optional sleeve member 70 is shown. Sleeve member 70 is an optional part that may be disposed in barrel 30. If provided, sleeve member 70 may include an open end 78 that may receive at least a portion of writing element 40. In the illustrative embodiment shown, sleeve member 70 is a substantially tubular member that receives non-writing end 44 of writing element 40.

As discussed above, attachment lugs 72 and/or first engagement member 74 may be provided on sleeve member 70. This configuration may facilitate easy removal and/or replacement of writing element 40. For example, as shown in FIG. 1, barrel 30 may be provided with a moveable or removable front section 39 to allow channel 33 to be accessed and writing element 40 to be removed therefrom. Front section may be removably associated with barrel 30 by cooperating threads, cams, snaps, or any other method known by one of ordinary skill in the art. Thus, a user can, for example, remove front section 39 from barrel 30 and remove writing element 40, while sleeve member 70 remains in channel 33, and subsequently replace writing element 40 with a new one or one of a different color or type. In the case where sleeve member 70 is not provided, and attachment lugs 72 and/or first engagement member 74 are provided directly on writing element 40, removable front section 39 may be separated from barrel 30 at a location that provides access to the connection between actuator member 50 and writing element 40, such that writing element 40 can be disconnected from actuator member 50—thus facilitating removal and/or replacement of writing element 40.

As mentioned above, sleeve member 70 is an optional part of writing instrument 20. Accordingly, any reference to the sleeve member 70 in this specification may be equally applicable to writing element 40, and likewise, any reference to writing element 40 may be applicable to optional sleeve member 70.

Writing element 40 is preferably formed of a material that strikes a balance between flexibility and rigidity. More specifically, writing element 40 must be flexible enough to provide sufficient lateral deflection for engagement and disengagement of first and second engagement members 74, 36. In addition, writing element 40 must be rigid enough to maintain first and second engagement members 74, 36 engaged under the forces created during writing. Moreover, the material from which writing element 40 is formed should not take a permanent set, and should be resistant to breakage during deflection. Plastic cartridges, such as, without limitation, polypropylene or ethylene cartridges, have been found to provide the required balance between flexibility and rigidity.

As discussed above, the first and second engagement members 74, 36 may be dimensioned and configured such that writing element 40 is slightly deflected (laterally) when in the extended position. Due to its slightly deflected state, forces on writing end 42 of writing element 40 (e.g., caused by writing) may impart a bending moment to writing element 40 and cause additional deflection or bending. This additional deflection or bending may act as a suspension and provide a "softened" or "cushioned" feel to the user. One of ordinary skill in the art will know and appreciate that the amount of lateral deflection initially imparted to writing element 40 by first and second engagement members 74, 36 may be varied to provide a desirable amount of "cushioning" at writing end 42. One of ordinary skill in the art will also know and appreciate that writing instrument 20 may be configured and dimensioned to provide substantially no "cushioning" at writing end 42.

While various descriptions of the present invention are described above, it should be understood that the various features can be used singly or in any combination thereof. In particular, the various inventive concepts need not be used in conjunction and only one of the inventive concepts may be provided without detracting from the invention. Therefore, this invention is not to be limited to only the specifically preferred embodiments depicted herein.

Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A writing instrument comprising:

a barrel having a channel, an open end, and a side surface;

an actuator located for on said side surface of said barrel; and a writing element disposed in said channel and movable along a longitudinal axis between a retracted position and an extended position;

a first engagement member associated with said writing element; and a second engagement member associated with said channel;

wherein:

said writing element is operatively connected to said actuator;

at least a portion of said writing element is resilient;

said writing element is deflected in a direction substantially transverse to the longitudinal axis upon being moved into said extended position; and the resiliency of said writing element biases said writing element to engage said channel and to retain said writing element in said extended position;

said first engagement member engages said second engagement member; and said second engagement member is a ledge formed on said channel.

2. The writing instrument of claim 1, wherein said writing element is bent such that the resiliency of said writing element biases said writing element to engage said channel.

3. The writing instrument of claim 1, wherein said first engagement member is a pawl.

4. The writing instrument of claim 1, wherein said writing element is a living spring.

5. The writing instrument of claim 1, wherein said writing element returns to a substantially straight configuration when in said extended position.

6. The writing instrument of claim 1, further comprising a release member located on a side surface of said barrel and movable from a rest position to a release position;

wherein movement of said release member to said release position disengages said writing element from said channel.

7. The writing instrument of claim 6, further comprising a first engagement member associated with said writing element and configured and dimensioned to engage said channel and to retain said writing element in said extended position;

wherein a portion of said release member contacts said first engagement member.

8. The writing instrument of claim 6, wherein said release member is a cantilever beam.

9. The writing instrument of claim 6, further comprising a grip element covering at least a portion of said release member.

10. The writing instrument of claim 6, wherein said release member is pivotably coupled to said barrel.

11. A writing instrument comprising:

a barrel having a channel, an open end, and a side surface;

an actuator located for on said side surface of said barrel;

a writing element disposed in said channel and movable along a longitudinal axis between a retracted position and an extended position;

a first engagement member comprising a pawl and associated with said writing element; and a second engagement member associated with said channel;

wherein:

said writing element is operatively connected to said actuator;

at least a portion of said writing element is resilient;

said writing element is deflected in a direction substantially transverse to the longitudinal axis upon being moved into said extended position;

the resiliency of said writing element biases said writing element to engage said channel and to retain said writing element in said extended position;

said first engagement member engages said second engagement member; and said second engagement member is a ledge formed on said channel.

12. The writing instrument of claim 1, further comprising a sleeve member disposed in said channel for receiving a portion of said writing element, wherein said sleeve member engages said channel to retain said writing element in said extended position.

13. The writing instrument of claim 12, further comprising a first engagement member located on said sleeve member.

14. A writing instrument comprising:

a barrel having an open end, a closed end, and a channel extending between said open end and said closed end;

a writing element having a writing end, said writing element being disposed in said channel and movable along a longitudinal axis between a retracted position with said writing end within said channel and an extended position with said writing end extending through and outside said open end;

a release member located on a side surface of said barrel and movable from a rest position to a release position; and a grip element farmed on said barrel;

wherein:

said writing element resiliently engages said channel to retain said writing element in said extended position;

movement of said writing element in a direction substantially transverse to the longitudinal axis disengages said writing element from said channel to return said writing element to said refracted position;

said release member comprises a portion of said grip element; and movement of said release member to said release position disengages said writing element from said channel.

15. The writing element of claim 14, wherein movement of said writing element in a direction substantially transverse to the longitudinal axis is caused by bending said writing element.

16. The writing instrument of claim 14, wherein said writing element is resilient.

17. The writing instrument of claim 14, wherein movement of said release member to said release position bends said writing element in a direction substantially transverse to the longitudinal axis.

18. The writing instrument of claim 14, further comprising a first engagement member associated with said writing element, said first engagement member configured and dimensioned to engage said channel and to retain said writing element in said extended position.

19. The writing instrument of claim 18, wherein a portion of said release member contacts said first engagement member.

20. The writing instrument of claim 18, wherein a portion of said release member contacts said writing element at a location spaced apart from said release member.

21. The writing instrument of claim 18, further comprising a second engagement member associated with said channel, wherein said first engagement member engages said second engagement member.

22. The writing instrument of claim 14, wherein said release member is a cantilever beam.

23. The writing instrument of claim 14, further comprising a grip element covering at least a portion of said release member.

24. The writing instrument of claim 14, wherein said release member is pivotably coupled to said barrel.

25. The writing instrument of claim 14, further comprising a sleeve member disposed in said channel for receiving a portion of said writing element, wherein said sleeve member resiliently engages said channel to retain said writing element in said extended position.

26. The writing instrument of claim 25, further comprising a first engagement member located on said sleeve member.

27. A writing instrument comprising:

a barrel having a substantially straight longitudinal channel and an open end through which a writing element is extendable along a longitudinal axis; and an actuator member disposed on a side surface of said barrel and movable between a first position defining a first length between said actuator member and said open end along the longitudinal axis, and a second position defining a second length between said actuator member and said barrel open end along the longitudinal axis, said second length being shorter than said first length;

wherein said actuator member moves along an arcuate path between said first position and said second position.

28. The writing instrument of claim 27, wherein said actuator member pivots as it moves between said first position and said second position.

29. The writing instrument of claim 27, wherein said actuator member is disposed on a non-planar surface, and slides along said non-planar surface between said first position and said second position.

30. The writing instrument of claim 29, wherein said non-planar surface is concave.

31. The writing instrument of claim 27, further comprising a writing element disposed in said channel and moveable between a retracted position and an extended position; wherein:

said writing element is in said retracted position when said actuator member is in said first position; and said writing element is in said extended position when said actuator member is in said second position.

32. The writing instrument of claim 31, wherein said writing element is pivotably coupled to said actuator member.

33. The writing instrument of claim 27, further comprising a sleeve member disposed in said channel for receiving a portion of a writing element, wherein said sleeve member is pivotably coupled to said actuator member.

34. A writing instrument comprising:

a barrel having a substantially straight longitudinal channel and an open end through which a writing element is extendable along a longitudinal axis; and an actuator member disposed on a side surface of said barrel and movable between a first position defining a first length between said actuator member and said open end along the longitudinal axis, and a second position defining a second length between said actuator member and said barrel open end along the longitudinal axis, said second length being shorter than said first length;

wherein said actuator member is disposed on a non-planar surface, and slides along said non-planar surface between said first position and said second position.

35. The writing instrument of claim 34, wherein said non-planar surface is concave.

36. A writing instrument comprising:

a barrel having a substantially straight longitudinal channel and an open end through which a writing element is extendable along a longitudinal axis;

an actuator member disposed on a side surface of said barrel and movable between a first position defining a first length between said actuator member and said open end along the longitudinal axis, and a second position defining a second length between said actuator member and said barrel open end along the longitudinal axis, said second length being shorter than said first length; and a writing element disposed in said channel and moveable between a retracted position and an extended position wherein:

said actuator member moves along a non-linear path between said first position and said second position;

said writing element is pivotably coupled to said actuator member;

said writing element is in said retracted position when said actuator member is in said first position;

and said writing element is in said extended position when said actuator member is in said second position.

* * * * *